US007165649B2

(12) United States Patent
Latimer et al.

(10) Patent No.: US 7,165,649 B2
(45) Date of Patent: Jan. 23, 2007

(54) POSITIONING SYSTEM FOR FOLDING LADDER AND METHOD OF INSTALLATION OF FOLDING LADDER USING POSITIONING SYSTEM

(75) Inventors: Brett A. Latimer, New Castle, PA (US); Ronald K. Burig, New Castle, PA (US); Christine A. Brown, Jamestown, PA (US); David E. Plotner, Sharpsville, PA (US); John J. Fiumefreddo, New Wilmington, PA (US); Roy B. Bendickson, Sharpsville, PA (US); David A. Winslow, Hermitage, PA (US)

(73) Assignee: Werner Co., Greenville, PA (US)

( * ) Notice: Subject to any disclaimer, the term of this patent is extended or adjusted under 35 U.S.C. 154(b) by 143 days.

(21) Appl. No.: 10/635,900

(22) Filed: Aug. 7, 2003

(65) Prior Publication Data

US 2005/0029042 A1 Feb. 10, 2005

(51) Int. Cl.
*E06C 9/00* (2006.01)

(52) U.S. Cl. ..... 182/77

(58) Field of Classification Search ..... 182/77–81; 49/342

See application file for complete search history.

(56) References Cited

U.S. PATENT DOCUMENTS

| | | | | |
|---|---|---|---|---|
| 2,572,281 A | | 10/1951 | Pierce | |
| 2,649,237 A | | 8/1953 | Bjorklund et al. | |
| 2,852,176 A | | 9/1958 | Harmon | |
| 3,901,353 A | | 8/1975 | Skolnik | |
| 4,281,733 A | * | 8/1981 | Miller et al. | 180/69.21 |
| 4,281,743 A | | 8/1981 | Fuller | |
| 4,541,508 A | | 9/1985 | Lundh | |
| 4,619,086 A | | 10/1986 | Naka | |
| 4,899,420 A | * | 2/1990 | Bye et al. | 16/16 |
| 6,367,199 B2 | * | 4/2002 | Sedlak et al. | 49/340 |
| 6,880,792 B2 | * | 4/2005 | Muir | 248/276.1 |
| 2003/0193199 A1 | * | 10/2003 | Talukdar et al. | 292/172 |

FOREIGN PATENT DOCUMENTS

| | | |
|---|---|---|
| JP | 61-45125 | 3/1986 |
| JP | 63-22959 | 1/1988 |

* cited by examiner

*Primary Examiner*—Alvin Chin-Shue
(74) *Attorney, Agent, or Firm*—McDermott Will & Emery LLP

(57) ABSTRACT

A support frame for a folding ladder, a folding ladder positioning system, and a method for installing a folding ladder, are disclosed and pertain to folding ladders disposable within an opening, such as openings in a ceiling of a house, to provide temporary access between one floor or space and another floor or space. In one aspect, a support frame includes a plurality of separable support frame plates collectively configured to circumscribe the opening and a plurality of connection sites are disposed at opposing ends of each of the plurality of separable support frame plates to facilitate connection of each support frame plate to adjacent support frame plates. The connection sites include, for example, mating locking connectors or a plurality of matching through-holes, which permit insertion of a fastening means therethrough.

9 Claims, 19 Drawing Sheets

POSITIONING SYSTEM FOR FOLDING LADDER AND METHOD OF INSTALLATION OF FOLDING LADDER USING POSITIONING SYSTEM

TECHNICAL FIELD

The disclosure relates generally to a folding ladder configured for installation in an opening, such as an opening in a ceiling of a house (e.g., attic ladder), an opening in a ceiling of a building floor, or an opening to a suspended storage space (e.g., an elevated garage storage area) to provide temporary access between one floor or space and another floor or space. The disclosure particularly relates to a positioning system for a folding ladder and a method for installation of a folding ladder.

BACKGROUND

Examples of attic ladders or "disappearing stairways" are shown, for example, in U.S. Pat. Nos. 2,649,237 and 2,852,176. These ladders normally fold and retract upwardly into a frame secured between adjacent joists of the attic, and the folded ladder is covered by a door which normally extends substantially flush with the finished ceiling of the room in which the ladder is mounted. Attic ladders thus take up no floor space except when actually extended and are also inexpensive to construct, as compared with fixed stairways typically constructed on-site.

U.S. Pat. No. 4,281,743 issued to Fuller on Aug. 4, 1981 shows another conventional attic ladder. As shown in FIG. 1 attic ladder 11 includes an outside frame 12 mounted between adjacent floor joists 13 of the attic floor 14. Cross braces 15 are mounted between a pair of adjacent floor joists 13 to provide end support for the frame 12 of the disappearing stairway. Ladder 11 is mounted in the ceiling by securing frame 12 to the joists 13 and the cross braces 15. A cover panel 16 forms part of ladder 11 and is hinged to the outer frame 12, so that the door becomes substantially flush with the ceiling 17 when the ladder 11 is folded. A first ladder portion 17 is affixed to the inner face of cover panel 16 and a second ladder portion 18 is pivotally hinged to the first ladder portion so as to be unfolded or folded when the ladder is opened or closed. While commercially available attic ladders or disappearing stairways typically come in a number of sizes, most come in several standard widths and lengths adaptable to fit conventional constructions.

U.S. Pat. No. 4,541,508 issued to Lundh on Sep. 17, 1985 shows yet another conventional attic ladder. In FIG. 2, a foldable ladder is shown to consist of a lower section 11, a central section 12 and an upper section 13. The central section 12 is hingedly connected to the two remaining sections 11,13 by a hinge so that the central section 12 and the lower section 11 can be folded up on the upper section 13. Upper section 13 is hingedly attached to a frame 14 by hinges 15, with the folding down movement of the upper ladder section 13 being limited by a pair of toggle joints 16,17, attached to the upper ladder section and to the frame 14. Toggle joints 16,17 are rigidly connected to each other at the lower arms by means of an axle 18 extending in parallel with the rungs of the ladder and are attached to the axle outside the side rails of the ladder. The ladder is spring-biased to a closed position by a gas spring 19 connected at one end to an outside of one side rail and connected at its other end, via piston rod 19*a*, to moment arm 18*a*, which is rigidly connected to the axle 18 at such an angle that a maximum moment is generated when the door is almost entirely closed. When the point of connection between the gas spring 19 and the moment arm 18*a* has passed the line for moment center (i.e. the connecting line between the attachment of the gas spring 19 to the ladder 13 and the axle 18, which passing takes place when the door is opened entirely), the gas spring 19 actuates the door so that it is locked in folded-down position, which is necessary because the "weight" of the door decreases as soon as the ladder sections are folded out.

As far as methods of installation are concerned, a typical method of installation of the folding ladder is shown in FIGS. 3(*a*)–6(*b*), described below.

FIG. 3(*a*) shows preparation of an opening 51 to receive a folding ladder, such as in an attic. An area is selected that is clear of wiring and plumbing and a rough opening is cut for the ladder next to at least one joist 50. A sub-frame is then created on-site using lengths of wood cut to fashion headers/footers 52 and spacers 54. FIG. 3(*b*) shows headers/footers 52 nailed to joists 50 at both ends and to the joist that was cut. Spacers 54 are nailed to the headers/footers 52 and an adjoining joist 50. The ladder's frame box 58 will be attached to this sub-frame.

FIG. 4(*a*) shows installation of temporary support brackets 56. Temporary support brackets are formed from pieces of wood, such as 5"×5" pieces of wood, attached to the ceiling at each corner of the opening by screwing them into the ceiling joists 50. A kit-made frame box 58 is assembled and lifted up through the opening 51 and then lowered to rest on the temporary support brackets 54. FIG. 4(*b*) shows attachment of the frame box 58. Shims (not shown) are used to center the frame box 58 in the subframe and to make sure it is level. The frame box 58 is then nailed to the sub-frame at a variety of points to secure the frame box and the temporary support brackets 56 are removed. The hatch door 62 is then attached to the frame box by a hinge 61 in such a manner as to provide a hatch that closes flush with the ceiling.

FIG. 5(*a*) shows both the installation of an individual wooden step 64 in a corresponding pair of grooves 65 in the left and right ladder rails 66, 68 and installation of all of the wooden steps 65 in the corresponding pairs of grooves in the left and right ladder rails, such as by inserting screws through the outside of the left and right ladder rails and into the steps. FIG. 5(*b*) shows the assembled folding ladder being folded about hinges 86, in the directions of the arrows, for installation. FIG. 5(*c*) shows that the folded ladder 70 is tied together with a string or strap 72 to prevent inadvertent unfolding of the ladder during installation. Following this step, a hand rail is attached to the uppermost (as-installed) ladder rail sections with a metal bracket and lower hanger arms are attached to selected ladder-to-hatch brackets 74.

FIG. 6(*a*) shows the conventional folding ladder assembly 70 following attachment of the folding ladder assembly to the hatch door 62 via ladder-to-hatch brackets 74. To set the ladder angle a string 75 is tied to a ladder step and is secured, at another end, to a footer portion 52 of the frame box 58 or support frame, as shown. A length of this string 75 is selected so as to provide and maintain the folding ladder at a desired angle during cutting of the ladder 70 to form a ladder foot 80. Alternatively, a second workman may hold the ladder at the desired angle during the ladder foot formation step. To create a foot 80 that is level with the floor, measuring sticks are used (labeled herein as "A" and "B" for descriptive purposes). Stick "B" 77 is placed on the front side of the ladder rail's second section 78 and stick "A" 76 is placed on the back of the ladder rail's third section 79, keeping the bottom of the stick level with the bottom of the rail (e.g., 66). A horizontal line may then be drawn across the rail (e.g., 66) that joins the marks on sticks "A" and "B" 76, 77 to denote the appropriate angle and the sticks 76, 77 are then translated up the ladder rails to intersect a lower portion of the lower ladder rail 79 and the horizontal line is transferred to the lower portion of the lower ladder rail. The sticks 76, 77 may also be used to determine an appropriate length of the lower portion of the lower ladder rail 79. The lower portion of the lower ladder rail 79 is then cut to form the foot.

FIG. 6(*b*) depicts downward rotation of the upper hanger arms 60, which are spring-loaded, and connection thereof to the lower hanger arms 85 at joint 87 to complete the conventional folding ladder assembly 70. Finally, an eye-bolt, rope, or some other access device may be installed so as to protrude from, or to be accessible from, an underside of the hatch, to thereby permit a person in the space below the ladder to rotate and open the hatch and the folding ladder by means of, for example, a hook.

However, additional improvements can be realized in the structure of the attic ladder support frame as well as the methods by which the attic ladder is installed. Efficiency and man power improvements can also be realized, as the conventional methods of installation require two people to assemble the ladder.

SUMMARY

In one aspect, there is provided a support frame for a foldable ladder configured for installation in an opening between one floor or space and another floor or space, including a plurality of separable support frame plates collectively configured to circumscribe the opening and a plurality of connection sites are disposed at opposing ends of each of the plurality of separable support frame plates to facilitate connection of each support frame plate to adjacent support frame plates. The connection sites include, for example, mating locking connectors or a plurality of matching through-holes, which permit insertion of a fastening means therethrough.

In yet another aspect, there is provided a strut positioning system for a foldable ladder configured for installation in an opening defined between one floor or space and another floor or space, the opening having a distal side to which a ladder is rotatably attached, a proximal side to which an opening or closing torque is applied to open or close the foldable ladder, and a first and a second lateral side, the strut positioning system comprising: a gas strut or a hydraulic strut having a proximal end and a distal end; a track configured for mounting in a fixed position relative to and along one of the first lateral side and the second lateral side of the opening defined between one floor or space and another floor or space; a rack plate comprising gear teeth configured to matingly engage corresponding pinion gear teeth and comprising a connector for connecting to the proximal end of the gas or hydraulic strut, the rack plate being configured for translational movement within the track from a first position to a second position, wherein the first position corresponds to a non-compressed state of the gas or hydraulic strut and the second position corresponds to a compressed state of the gas or hydraulic strut; a locking device configured to lock the rack plate in the second position; a pinion gear comprising teeth configured to matingly engage corresponding rack plate gear teeth and comprising a torque application member configured to matingly engage a torque application tool, the pinion gear being rotatably mounted in a fixed position on the lateral side of the opening within the track; wherein, upon connection of the distal end of the gas or hydraulic strut to one of a ladder and a link member attached to a ladder and compression of the gas or hydraulic strut by application of a torque to the pinion gear, the rack plate is locked in the second position.

In another aspect of the strut positioning system for a foldable ladder configured for installation in an opening defined between one floor or space and another floor or space, the opening having a distal side to which a ladder is rotatably attached, a proximal side to which an opening or closing torque is applied to open or close the foldable ladder, and a first and a second lateral side, there is provided a strut positioning system comprising: a gas strut or a hydraulic strut having a proximal end and a distal end; a track configured for mounting in a fixed position relative to and along one of the first lateral side and the second lateral side of the opening defined between one floor or space and another floor or space; a slide plate configured for translational movement within the track from a first position to a second position, wherein the first position corresponds to a non-compressed state of the gas or hydraulic strut and the second position corresponds to a compressed state of the gas or hydraulic strut; a means for locking the rack plate in the second position; wherein, upon connection of the distal end of the gas or hydraulic strut to a ladder or a link member attached to a ladder and compression of the gas or hydraulic strut, the slide plate is locked in the second position.

In still another aspect, there is provided a method for installing a foldable ladder configured for installation in an opening defined between one floor or space and another floor or space, the method comprising: defining an opening having a distal side to which a ladder is rotatably attached, a proximal side to which an opening or closing torque is applied to open or close the foldable ladder, and a first and a second lateral side; installing a strut positioning system within a perimeter of the opening, the strut positioning system comprising a track configured for mounting in a fixed position relative to and along one of the first lateral side and the second lateral side of the opening defined between one floor or space and another floor or space; a rack plate comprising gear teeth configured to matingly engage corresponding pinion gear teeth and comprising a connector for connecting to an end of a strut, the rack plate being configured for translational movement within the track from a first position to a second position, wherein the first position corresponds to a non-compressed state of the strut and the second position corresponds to a compressed state of the strut; a locking device configured to lock the rack plate in the second position; and a pinion gear comprising teeth configured to matingly engage corresponding rack plate gear teeth and comprising a torque application member configured to matingly engage a torque application tool, the pinion gear being rotatably mounted in a fixed position on the lateral side of the opening within the track; positioning a folded ladder assembly at least partially within the opening and securing the folded ladder assembly relative to the opening; pivoting the folded ladder assembly forwardly until the folded ladder is sufficiently close to the support frame to permit attachment of curved brackets connecting upper lateral ends of the folded ladder to connectors provided on the first and second lateral sides of the opening attaching one end of a strut, comprising at least one of a gas strut and a hydraulic strut, to one of the folded ladder and an extension member attached to the folded ladder and attaching another end of the strut to the rack plate connector when the rack plate is positioned at the first position, wherein the strut is in an non-compressed state; applying a torque to the pinion gear to corresponding move the rack plate along the track from the first position to the second position and to thereby compress the strut; and securing the rack plate at the second position.

In another aspect of a method for installing a foldable ladder configured for installation in an opening defined between one floor or space and another floor or space, the method includes defining an opening having a distal side to which a ladder is rotatably attached, a proximal side to which an opening or closing torque is applied to open or close the foldable ladder, and a first and a second lateral side; assembling a support frame assembly; installing the support frame assembly along an inner perimeter of the opening; installing a strut positioning system along at least lateral side of the support frame assembly, the strut positioning system comprising a track configured for mounting in a fixed position relative to and along one of the first lateral side and the second lateral side of the opening defined between one floor or space and another floor or space; a rack plate comprising gear teeth configured to matingly engage corresponding pinion gear teeth and comprising a connector for connecting to an end of a strut, the rack plate being configured for translational movement within the track from a first position to a second position, wherein the first position corresponds to a non-compressed state of the strut and the second position corresponds to a compressed state of the strut; a locking device configured to lock the rack plate in the second position; and a pinion gear comprising teeth configured to matingly engage corresponding rack plate gear teeth and comprising a torque application member configured to matingly engage a torque application tool, the pinion gear being rotatably mounted in a fixed position on the lateral side of the opening within the track; positioning a folded ladder assembly at least partially within the opening and securing the folded ladder assembly to the support frame assembly; pivoting the folded ladder assembly forwardly until the folded ladder is sufficiently close to the support frame to permit attachment of curved brackets connecting upper lateral ends of the folded ladder to connectors provided on lateral sides of the support frame; attaching one end of a strut, comprising at least one of a gas strut and a hydraulic strut, to one of the folded ladder and an extension member attached to the folded ladder and attaching another end of the strut to the rack plate connector when the rack plate is positioned at the first position, wherein the strut is in an non-compressed state; applying a torque to the pinion gear to corresponding move the rack plate along the track from the first position to the second position and to thereby compress the strut; securing the rack plate at the second position.

In yet another aspect of a method for installing a foldable ladder configured for installation in an opening defined between one floor or space and another floor or space, the method comprising: defining an opening having a distal side to which a ladder is rotatably attached, a proximal side to which an opening or closing torque is applied to open or close the foldable ladder, and a first and a second lateral side; installing a strut positioning system along at least lateral side of the support frame assembly, the strut positioning system comprising a track configured for mounting in a fixed position relative to and along one of the first lateral side and the second lateral side of the opening; a slide plate configured for translational movement within the track from a first position to a second position, positioning a folded ladder assembly at least partially within the opening and securing the folded ladder assembly relative to the opening; attaching curved brackets connecting upper lateral ends of the folded ladder to connectors provided at the first and second lateral sides of the opening; attaching one end of a strut, comprising at least one of a gas strut and a hydraulic strut, to one of the folded ladder and an extension member attached to the folded ladder and attaching another end of the strut to the slide plate when the rack plate is positioned at the first position, wherein the strut is in an non-compressed state; moving the slide plate from the first position toward the second position along the track to compress the strut; and securing the rack plate at the second position.

Additional advantages will become readily apparent to those skilled in this art from the following detailed description, wherein only the a preferred example of the present concepts are shown and described. As will be realized, the disclosed concepts are capable of other and different embodiments, and its several details are capable of modifications in various obvious respects, all without departing from the spirit thereof. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein:

FIG. 3(*b*) depicts a step in the preparation of a conventional folding ladder subframe;

FIG. 4(*b*) shows another step in the installation of a conventional folding ladder including attachment of the frame box;

FIG. 6(*b*) depicts connection of the upper hanger arms to the lower hanger arms to complete the conventional folding ladder assembly.

DETAILED DESCRIPTION

Figure 1:
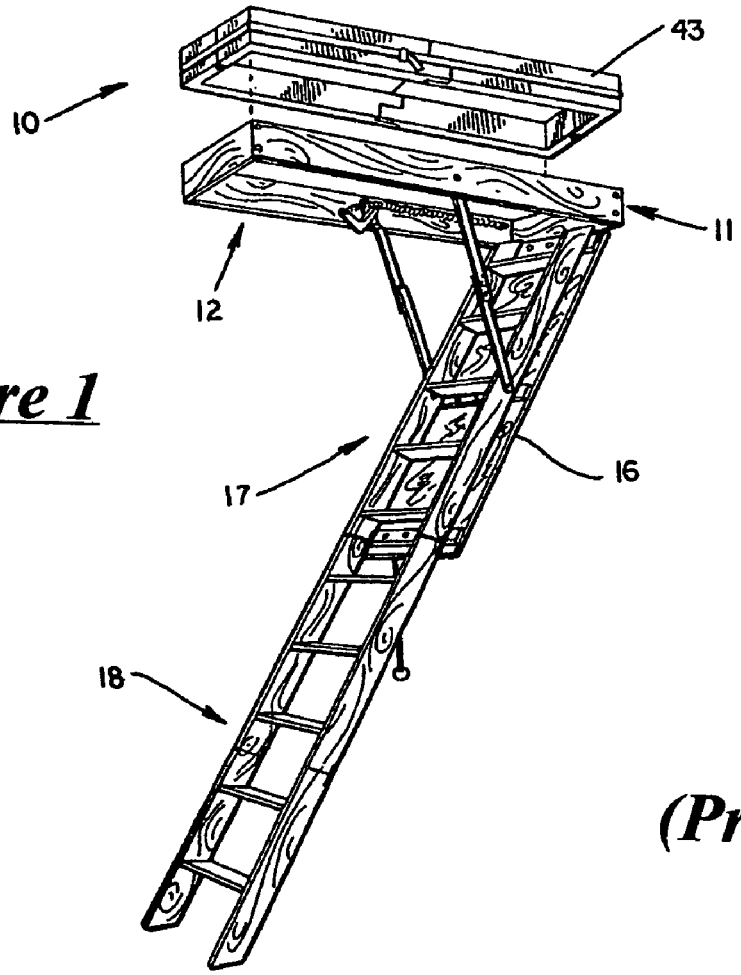
Figure 1 (Prior Art)
FIG. 1 is a perspective view of a conventional folding ladder disposed in an opening.
Figure 2:
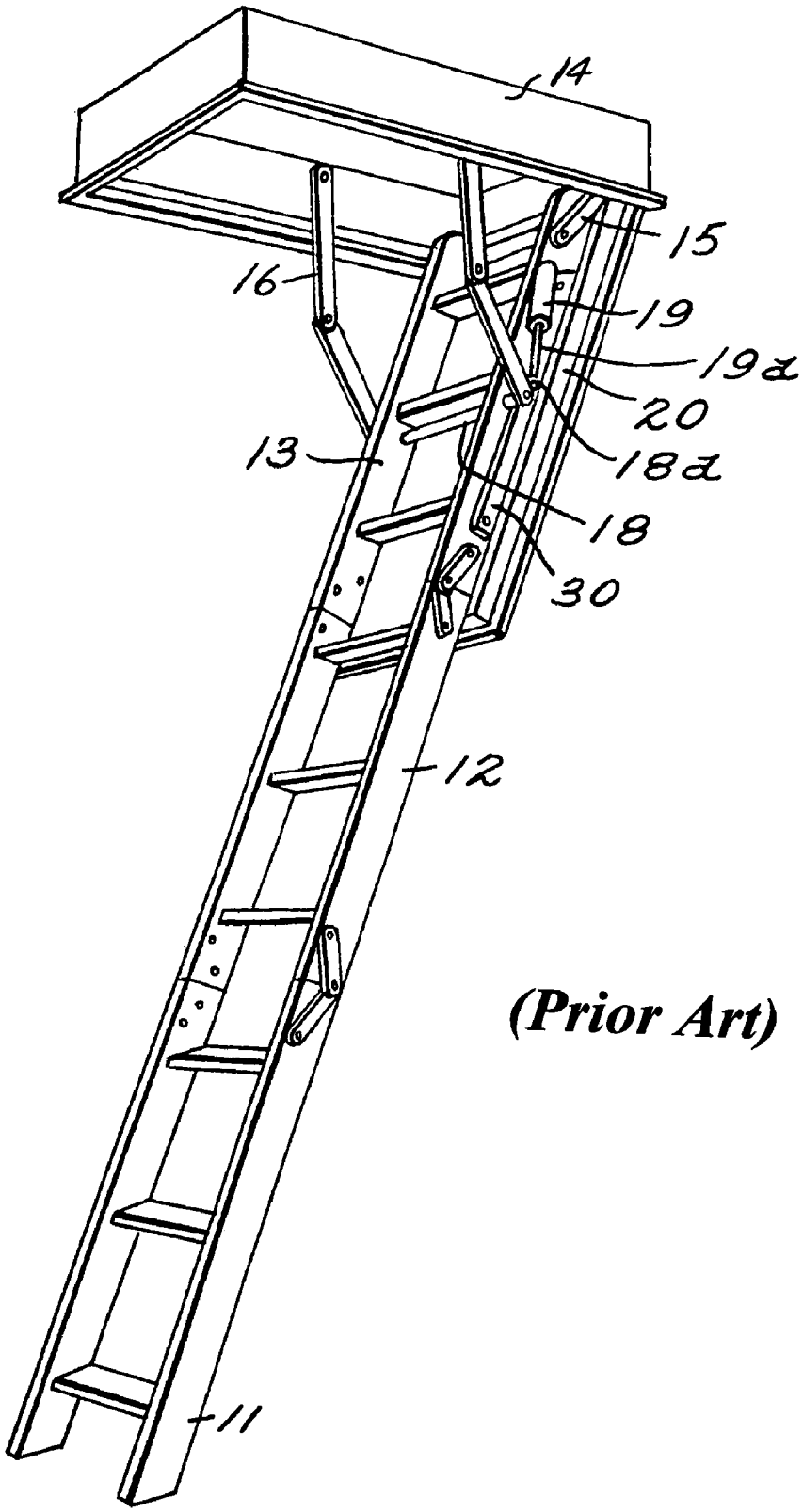
(Prior Art) Figure 2
FIG. 2 is a perspective view of another conventional folding ladder disposed in an opening.
Figure 3A:
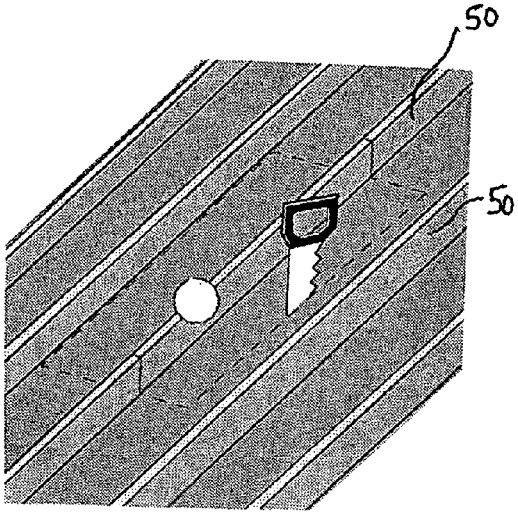
Figure 3(a) (Prior Art)
FIG. 3(*a*) shows preparation of an opening to receive a conventional folding ladder.
Figure 3B:
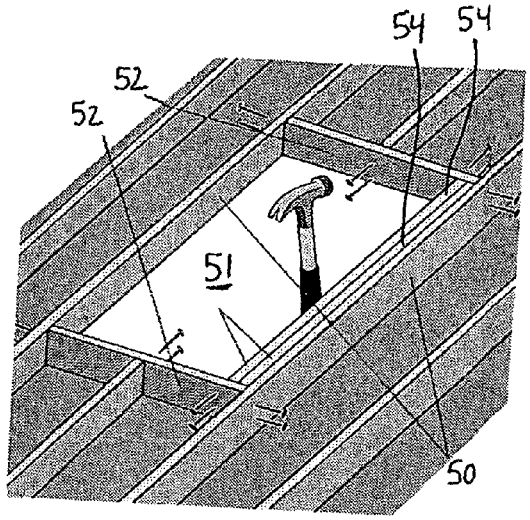
Figure 3(b) (Prior Art)
Figure 4A:
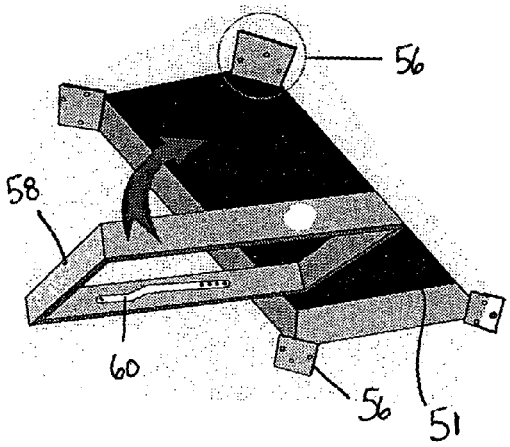
Figure 4(a) (Prior Art)
FIG. 4(*a*) depicts a step in the installation of a conventional folding ladder including installation of temporary support brackets.
Figure 4B:
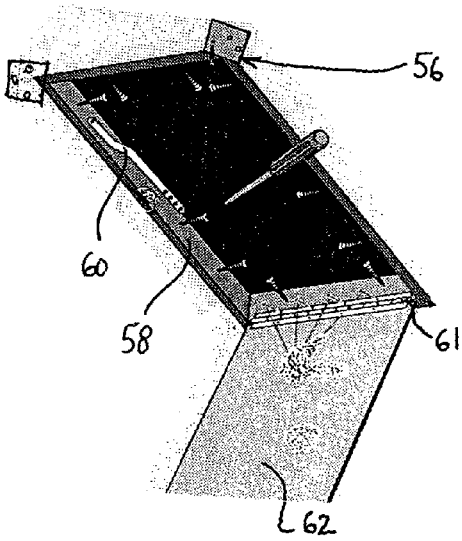
Figure 4(b) (Prior Art)
Figure 5A:
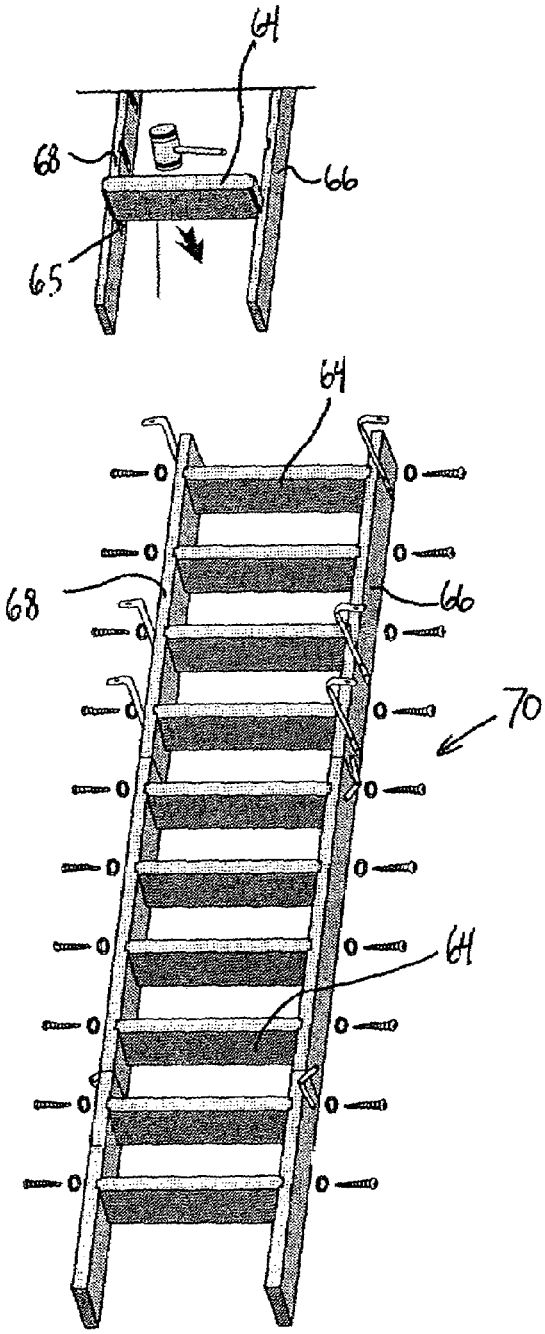
Figure 5(a) (Prior Art)
FIGS. 5(*a*)–(*c*) show additional steps in the installation of a conventional folding ladder including the installation of an individual wooden step, securement of the steps, folding the ladder for installation, and tying the folded ladder to prevent inadvertent unfolding of the ladder during installation.
Figure 5B:
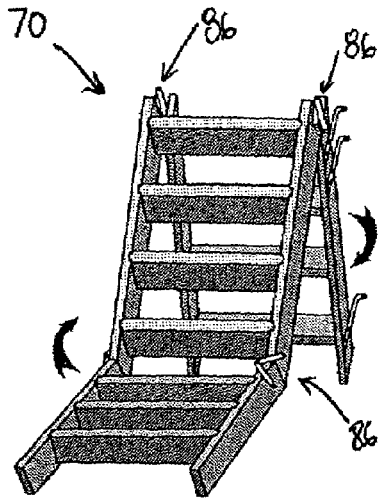
Figure 5(b) (Prior Art)
Figure 5C:
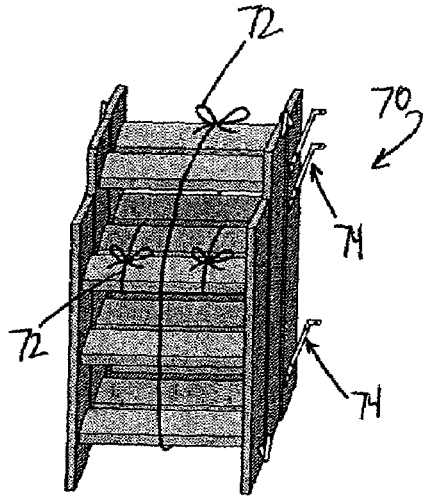
Figure 5(c) (Prior Art)
Figure 6A:
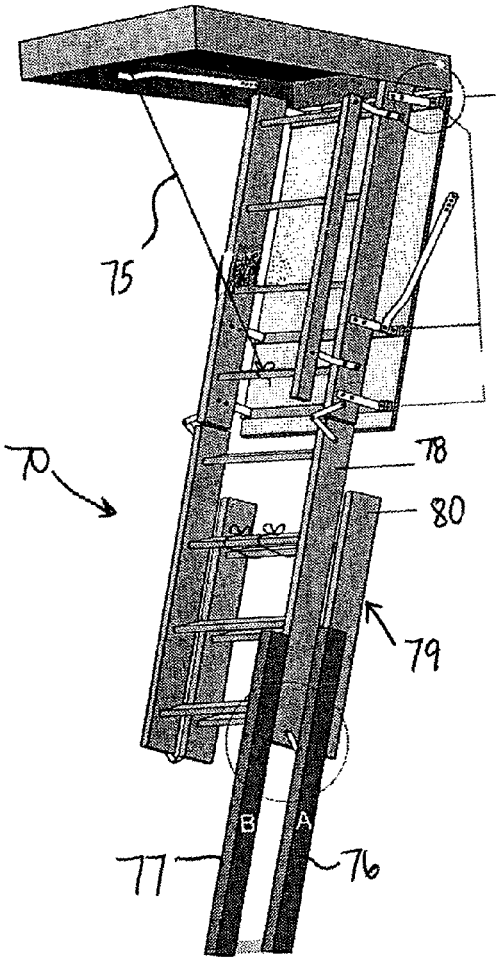
Figure 6(a) (Prior Art)
FIG. 6(*a*) illustrates a conventional folding ladder assembly following attachment to the hatch door via the ladder-to-hatch brackets and intermediate steps of setting the ladder angle and creating a ladder foot that is level with the floor.
Figure 6B:
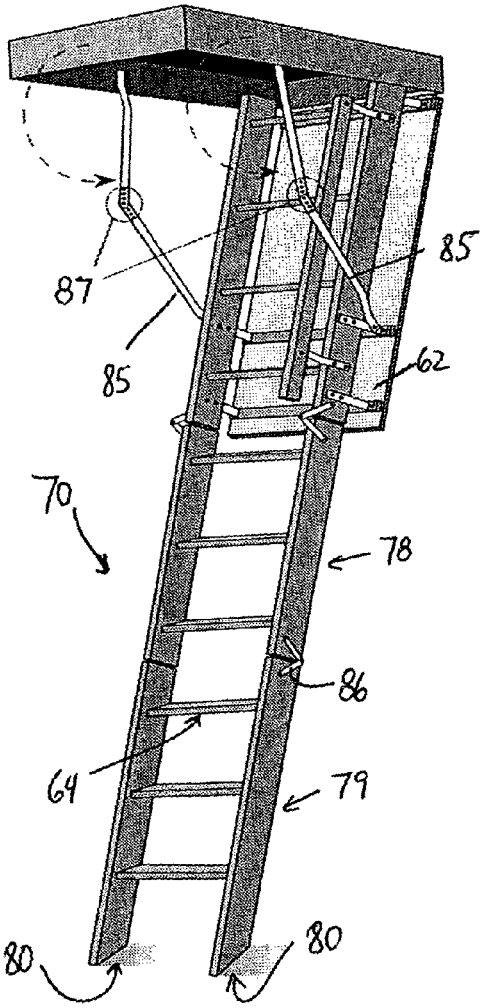
Figure 6(b) (Prior Art)
Figure 7A:
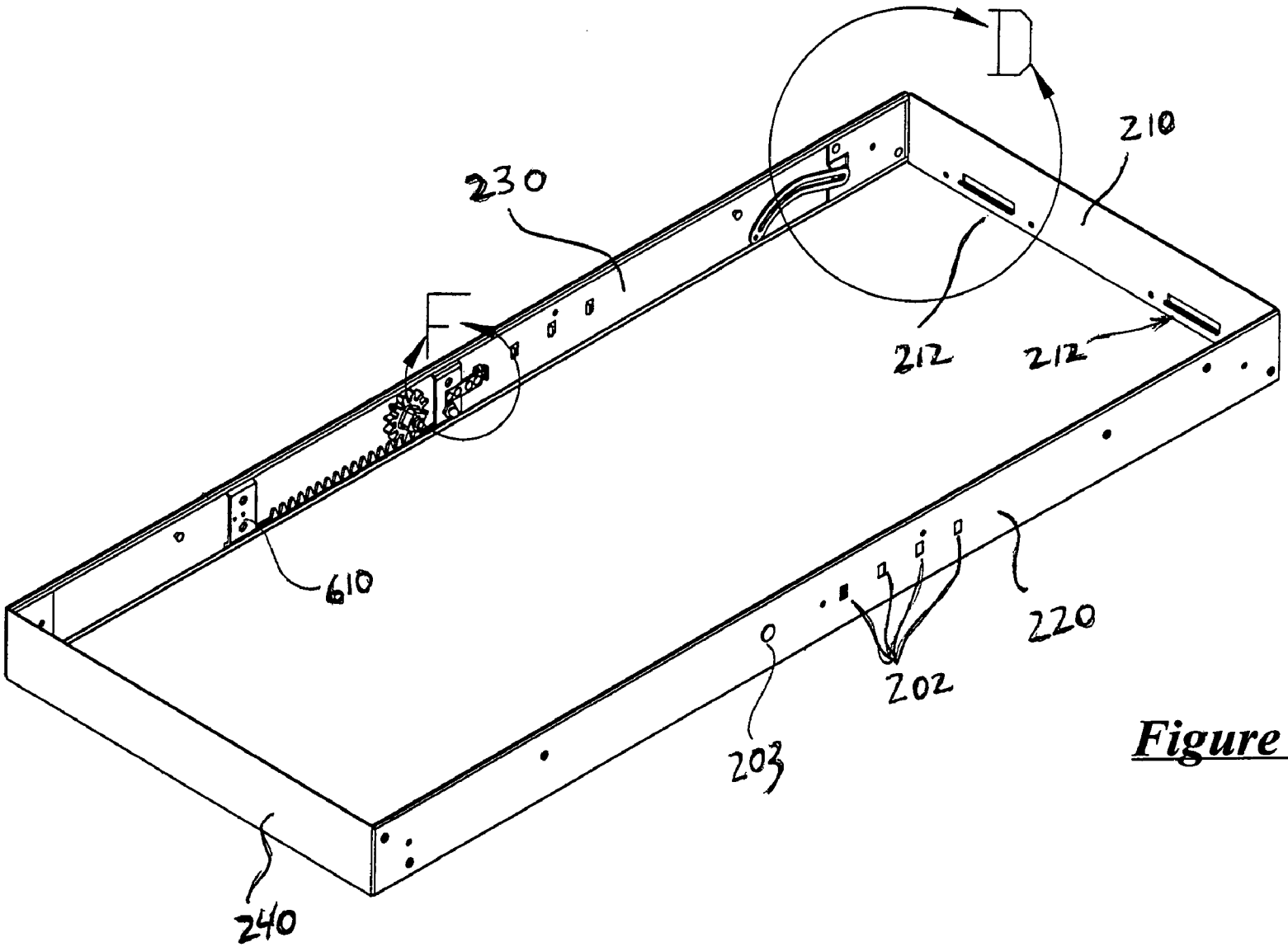
FIGS. 7(*a*)–7(*d*) are, respectively, a perspective view of the support frame, an exploded perspective view of a head portion of the support frame, a top view of the support frame, and a side view of the support frame in accord with the present concepts.
Figure 7B:
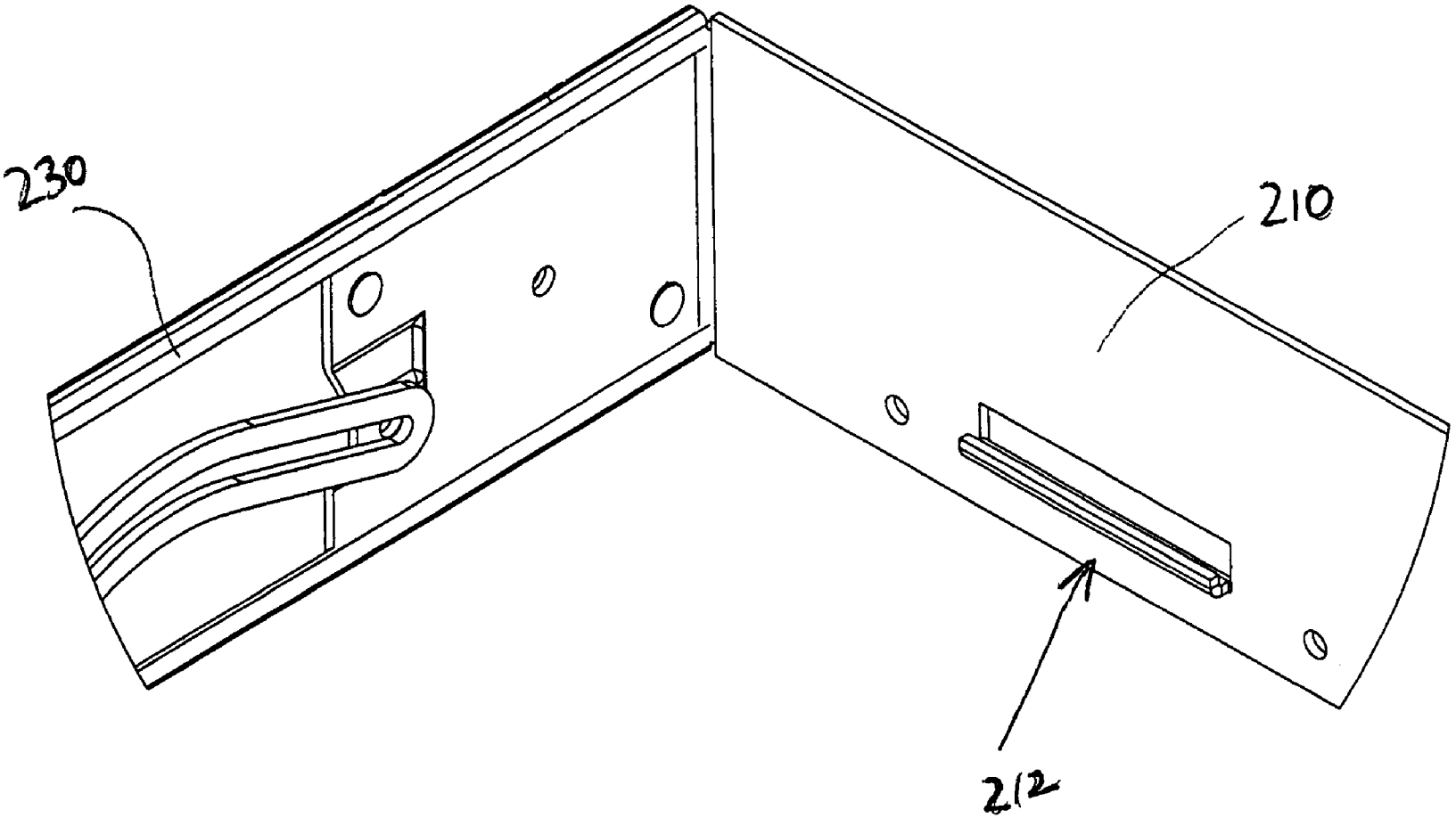
Figure 7C:
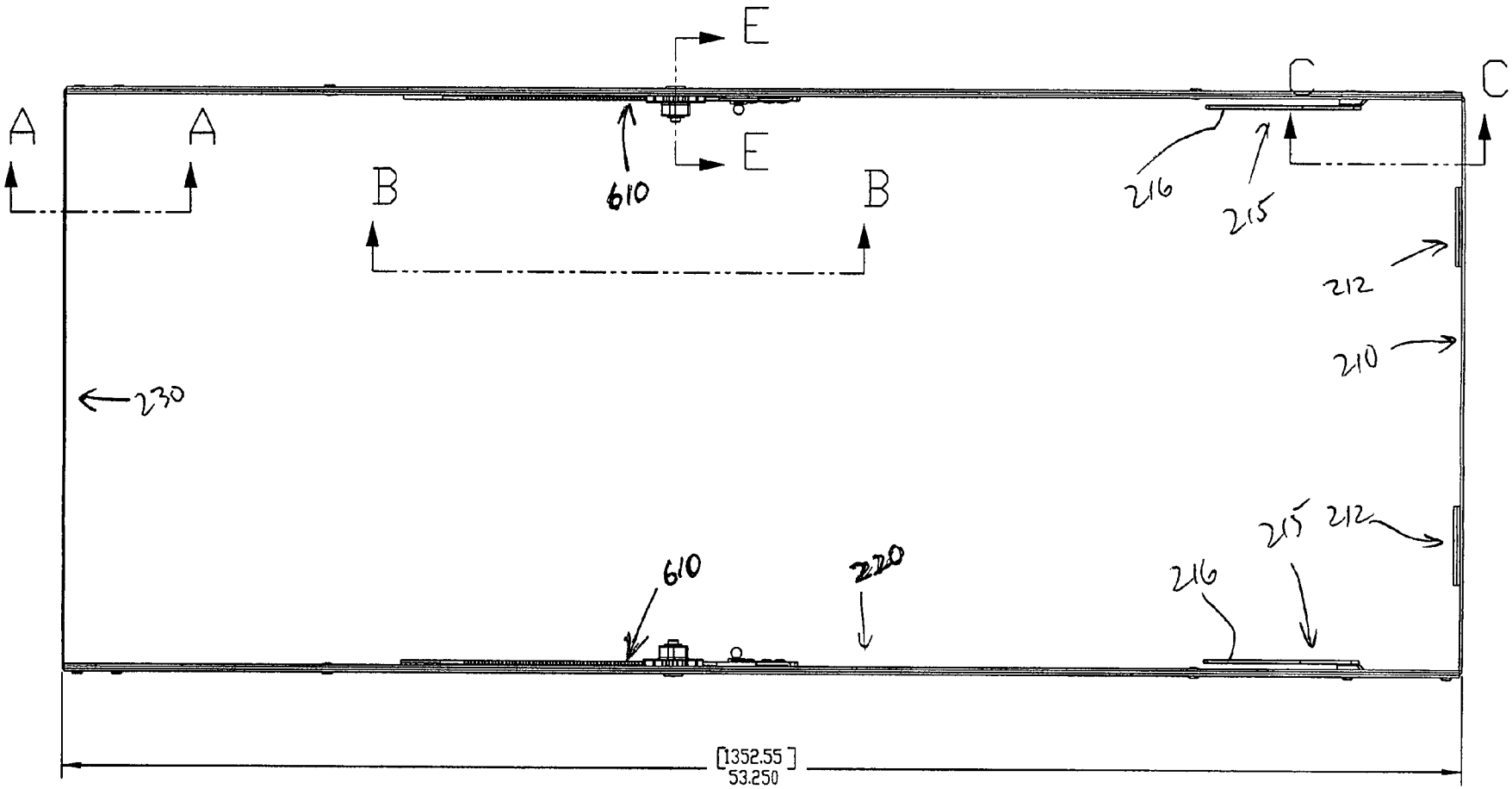
Figure 7D:
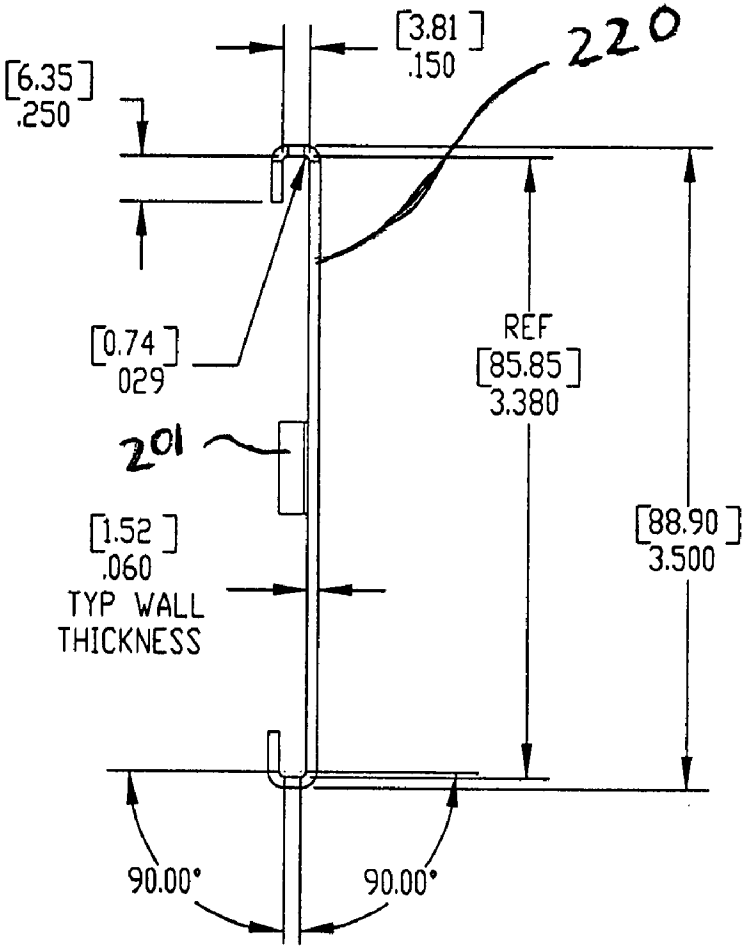

With reference to the attached drawings, there is described a folding ladder and various features including but not limited to locking mechanisms, positioning mechanisms, and movable steps, as well as a support frame and methods of installation of the support frame and folding ladder in an opening to provide access between spaces on opposite sides of the opening.

In one aspect of the folding ladder support frame, shown in FIGS. 7(*a*)–7(*d*), the support frame is made up of four sections comprising a separate head plate 210, a right side plate 220, a left side plate 230, and a foot plate 240. These plates may be assembled at a job-site together and fastened together, such as by screws or rivets, or snapped together through an appropriate snap-lock connection to thereby form a unitary frame. It is preferred that the frame comprise a metal or metal alloy, such as but not limited to a commercial-grade steel, which permits the frame sections to be manufactured using cost effective and reliable techniques, such as stamping and rolling. Such non-limiting techniques (e.g., any conventional casting method could also be utilized) permit features, such as the openings 202, tabs 201, and hinge slots 212 to be easily incorporated into the support frame 200 to facilitate the addition or operation of other mechanisms which, as discussed below, enable installation of the frame more quickly and with less tools and installers than required by conventional installations.

Side plates 220, 230, shown in FIG. 7(*a*), are each 1347.8 mm long in the depicted example and are 88.9 mm high (see FIG. 7(*d*)). Top and bottom edges of the side plates 220, 230 are bent inwardly as shown in FIG. 7(*d*) into a roughly U-shaped or C-shaped section defining a gap of about 3.8 mm between the edges of the bent portion. The shaped section (e.g., U-shaped or C-shaped) or bend provides a track within which the rack plate 610, depicted in FIGS. 7(*a*)–(*b*), can be guided as it moves during the installation process, as described below. The bend or shaped section also provides a track within which the ends of the head plate 210 and the foot plate 240 may be inserted and moved during installation thereof. In another aspect of the invention, the ends of the head plate 210 and the foot plate 240 need not be bent as shown in FIG. 7(*b*) and may instead be substantially planar. Such aspect permits additional variability in lateral placement of the head plate 210 and the foot plate 240 relative to the side plates 220, 230. Lateral adjustments may be realized, for example, by flanged connectors on side plates 220, 230, which bear through-holes positionable with respect to slots in the head and foot plates 210, 240.

FIG. 7(*c*) shows a strut positioning system 600 attached to opposing sides of the support frame 200 along a major longitudinal axis of the frame. Each strut positioning system 600 comprises a rack plate 610, a gear 615 and ratchet system 620. The gear 615 is rotatably affixed to the support frame assembly 200 by means of a shaft or gear pin disposed in an opening or hole 203 formed at a point about 757.3 mm from the rightmost edge of the example shown in FIGS. 7(*a*)–(*c*). Hole 203 is, in the illustrated example, displaced downwardly from a top edge of the support side plate (e.g., 230) by about 40.1 mm and up from a longitudinal centerline by about 13.4 mm. Openings 202 are, in the illustrated example, about 9.53 mm deep and 15.88 mm high. In one aspect, gear 615 is supported by a C1006 steel gear pin having a proximal base diameter of 19.05 mm, a shaft diameter of 9.53 mm, and a groove configured to receive a retaining clip or ring at a distal portion thereof. Thus, the rack plates 610 are configured to move along a major longitudinal axis of the frame 200 during installation of the strut positioning system 600, described below, and the gears 615 are adapted to facilitate alignment and smooth motion of the rack plates 610 during such installation.

Figure 8:
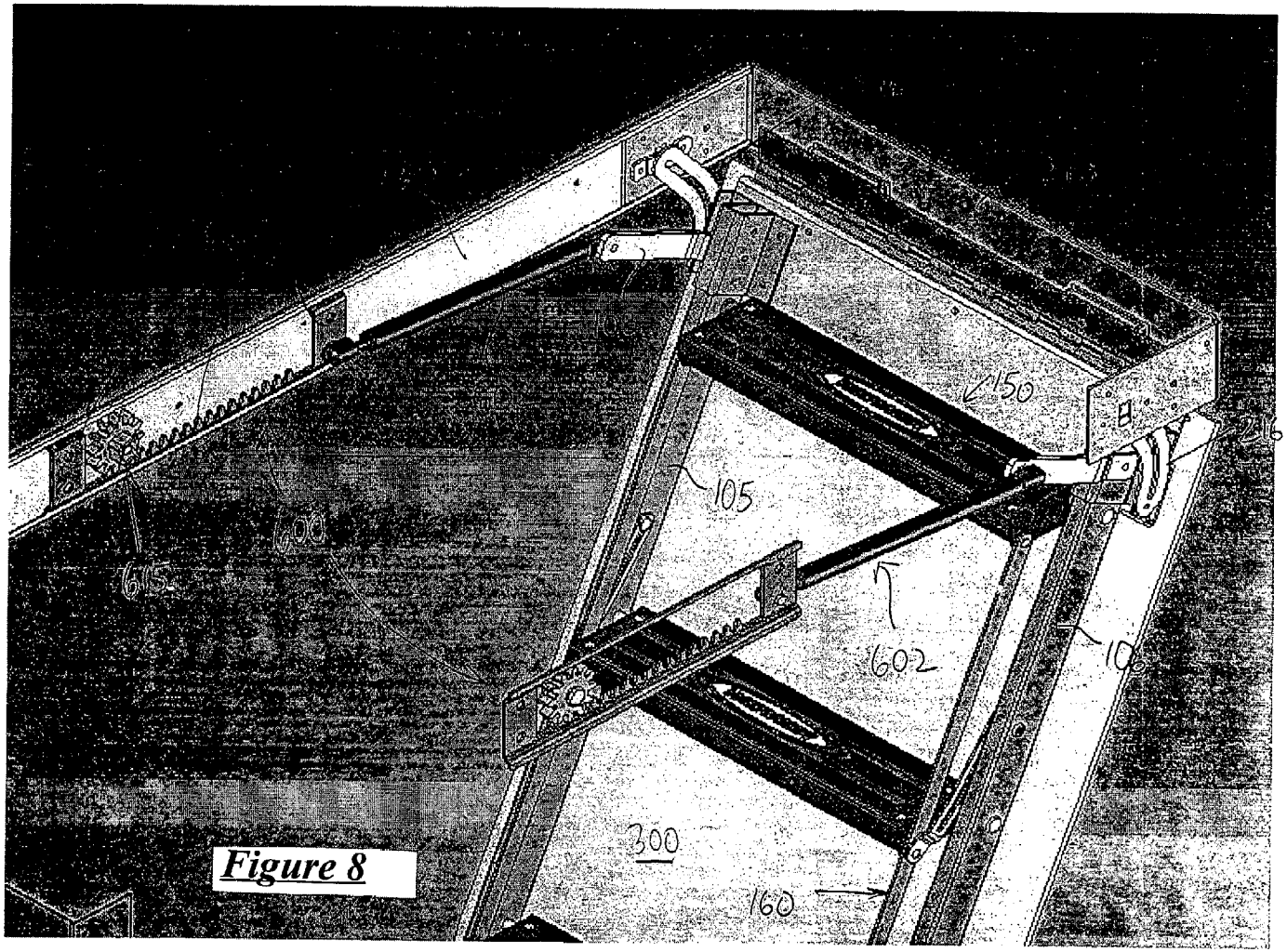
FIG. 8 is a top-perspective view of a gas strut positioning system for a folding ladder and support frame in accord with the present concepts.

FIG. 8 shows a top-perspective view of one strut positioning system 600 for a folding ladder and support frame in accord with the present concepts. The strut may comprises a gas strut or a hydraulic strut (i.e., the actual fluid(s) employed by the strut may vary)). Strut 602 is, in one aspect, a Suspa 445 N gas strut with a stroke length of 200 mm (compressed length of 300 mm and extended length of 500 mm)(Part No. C16-08054). Generally speaking, the strut 602 is used to control the force required to open or close the folding ladder 100. Strut 602, which maintains a fully open position unless forced into compression, provides several advantages over the common lever and spring mechanisms use in conventional attic ladders (e.g., occupying less space) and confers a smooth force distribution and permits improved control over the force and velocity of the ladder 100 during opening or closing.

Figure 9:
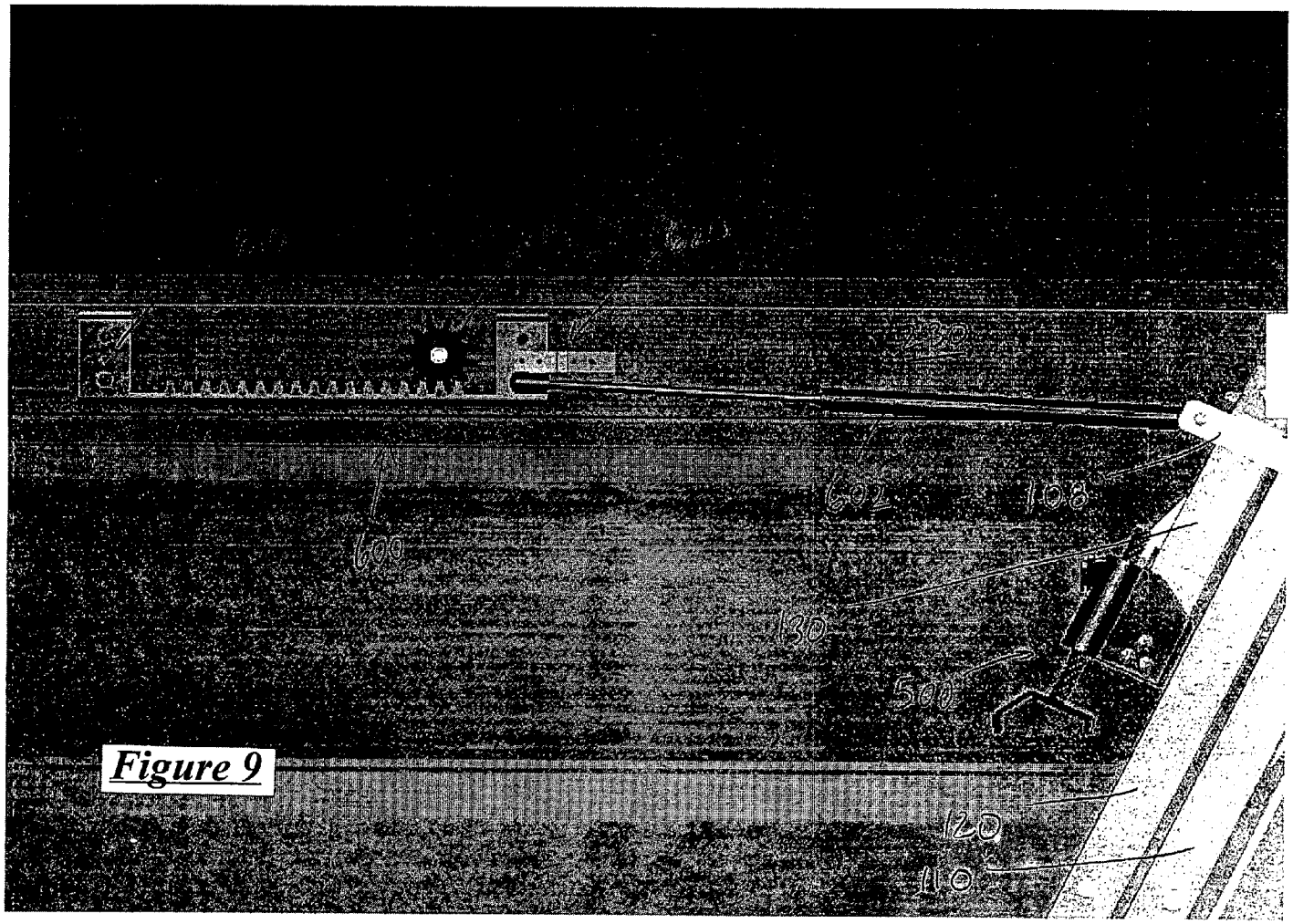
FIG. 9 is a side views of a gas strut positioning system for a folding ladder and support frame in accord with the present concepts wherein the gas strut in a fully compressed position.
Figure 10:
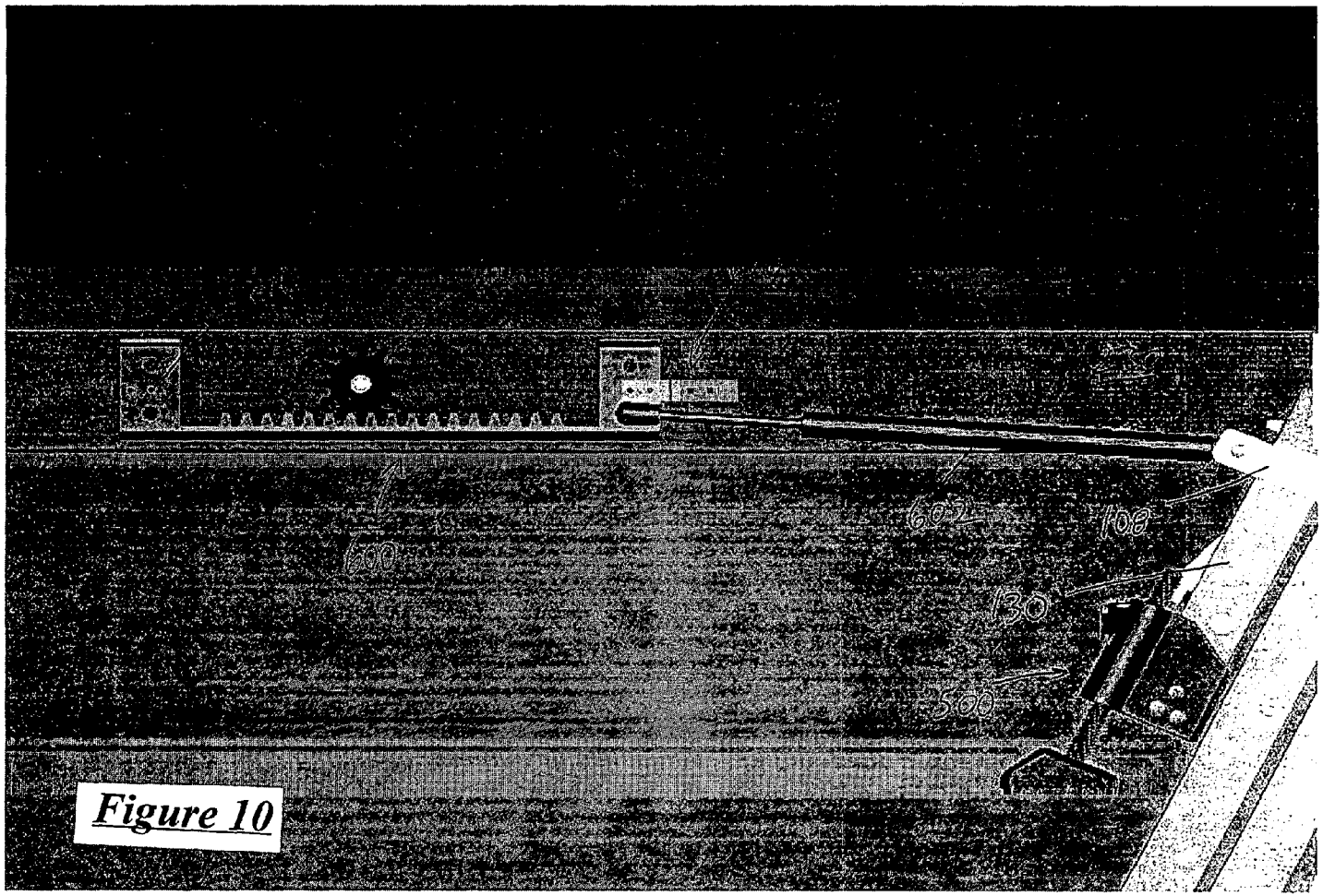
FIG. 10 is a side views of a gas strut positioning system for a folding ladder and support frame in accord with the present concepts wherein the gas strut in a fully extended position.

FIGS. 9 and 10 respectively show side views of a strut positioning system 600 for a folding ladder and support frame in accord with the present concepts wherein the gas strut 605 is in a fully extended position and a fully compressed position, as is more fully described below.

Figure 11A:
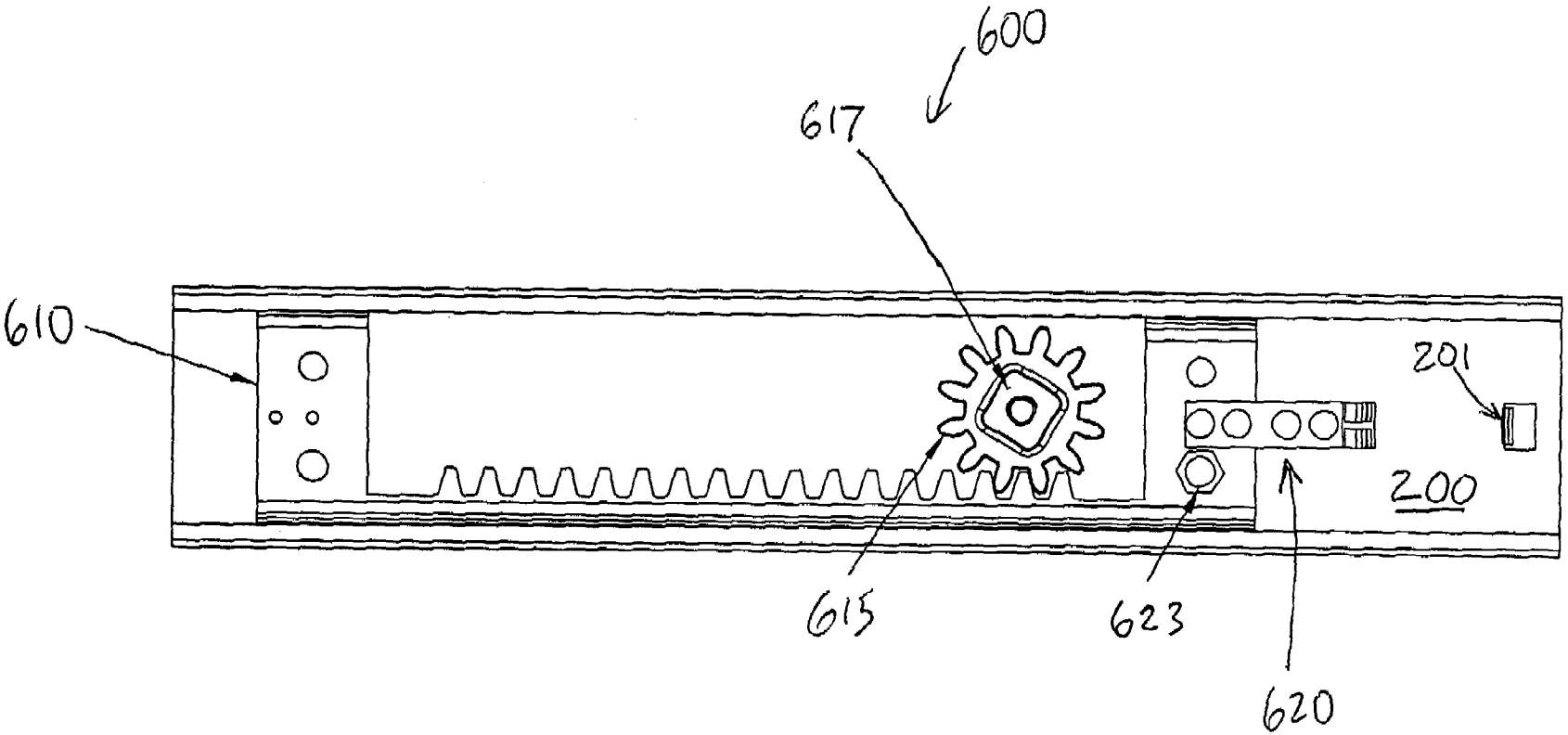
FIGS. 11(*a*)–(*b*) is a side view of a gas strut positioning system and exploded isometric view of a ratchet system thereof in accord with the present concepts.
Figure 11B:
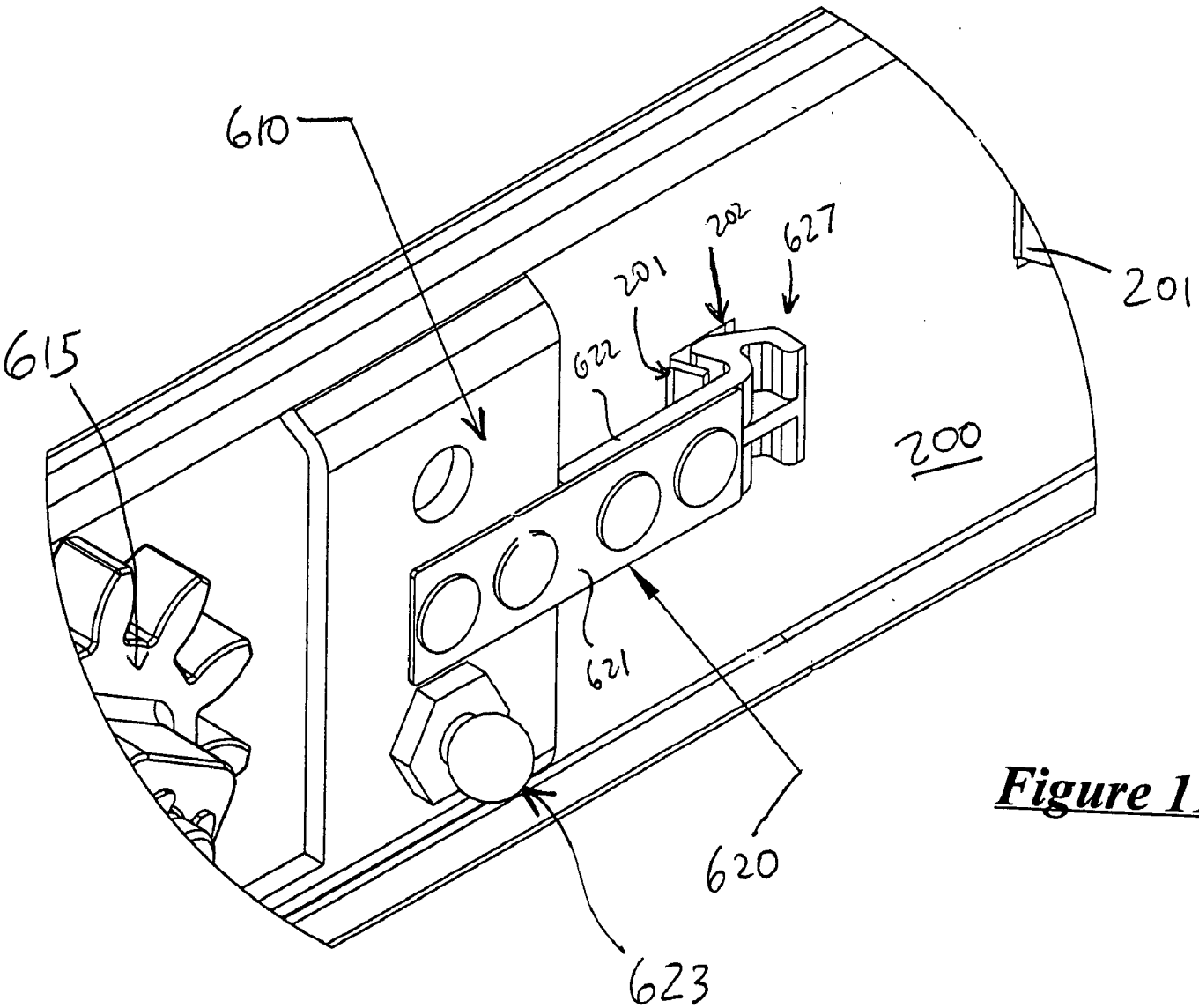
Figure 12A:
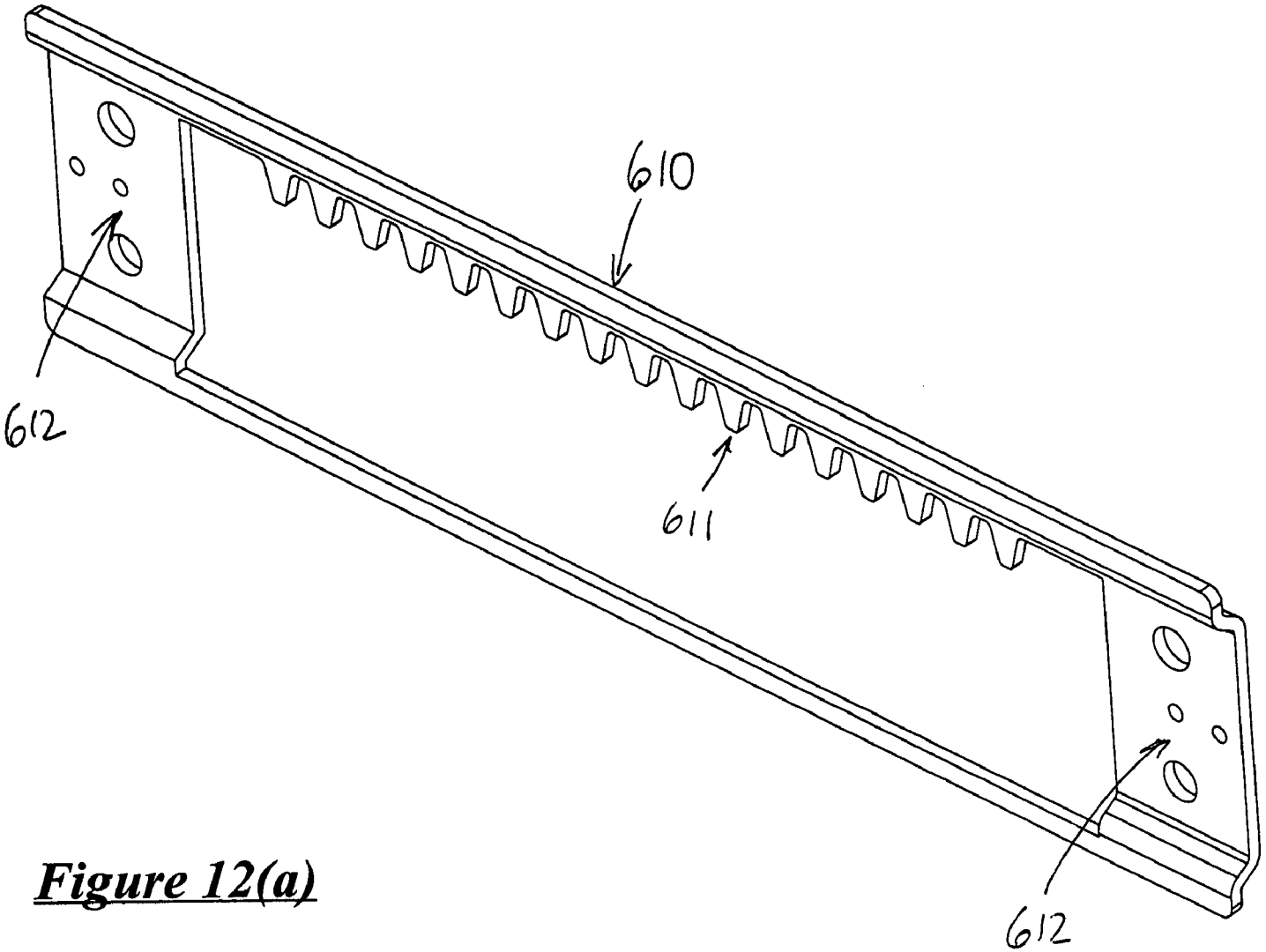
FIGS. 12(*a*)–(*d*) respectively show isometric, side, front, and exploded detail views of a gas strut positioning system rack plate in accord with the present concepts.
Figure 12B:
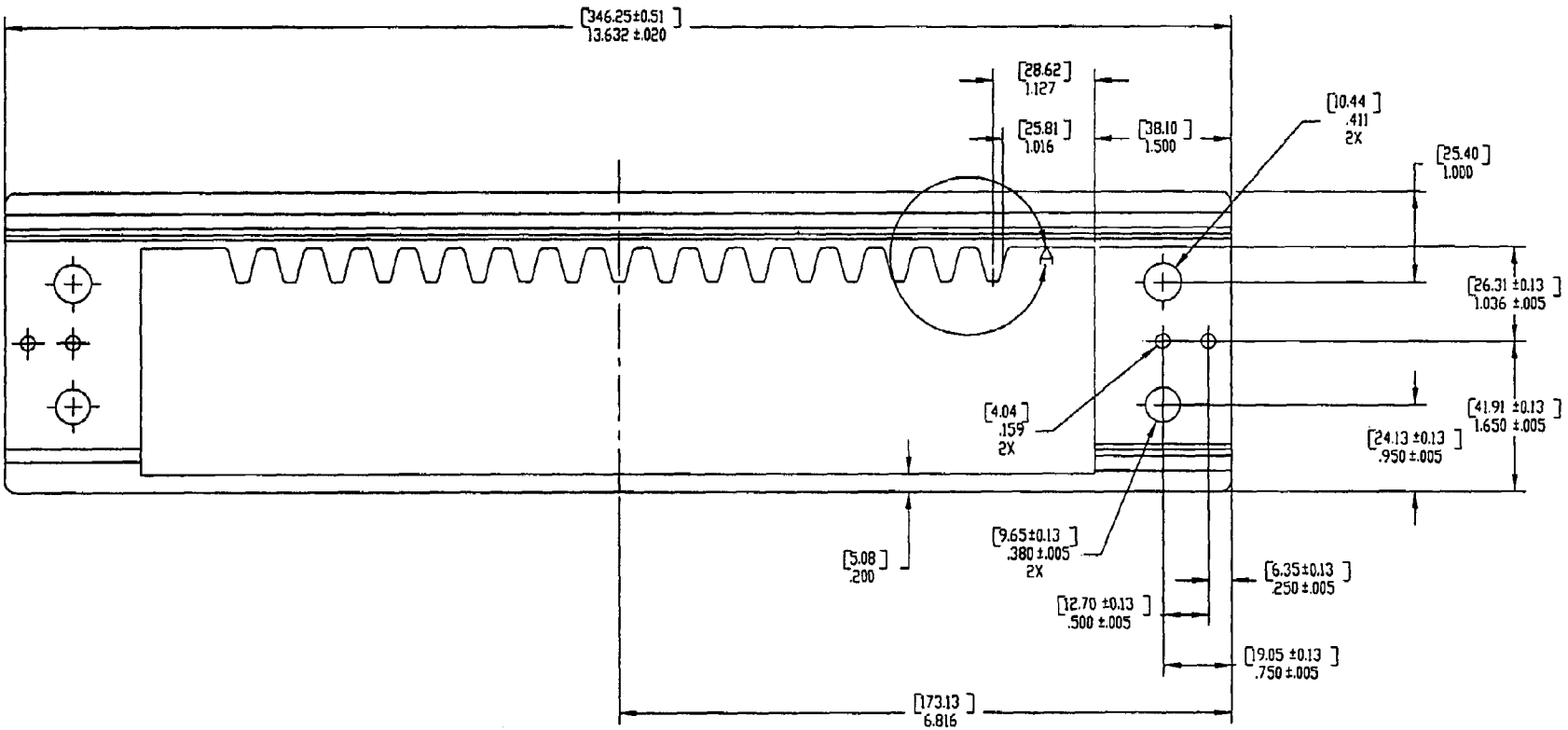
Figure 12D:
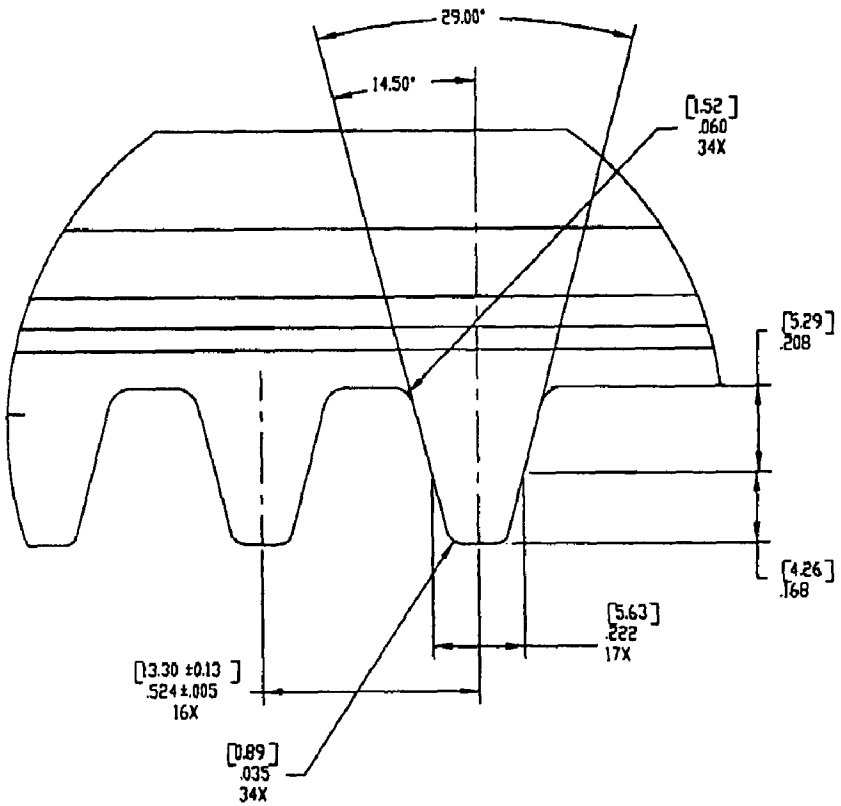
Figure 12C:
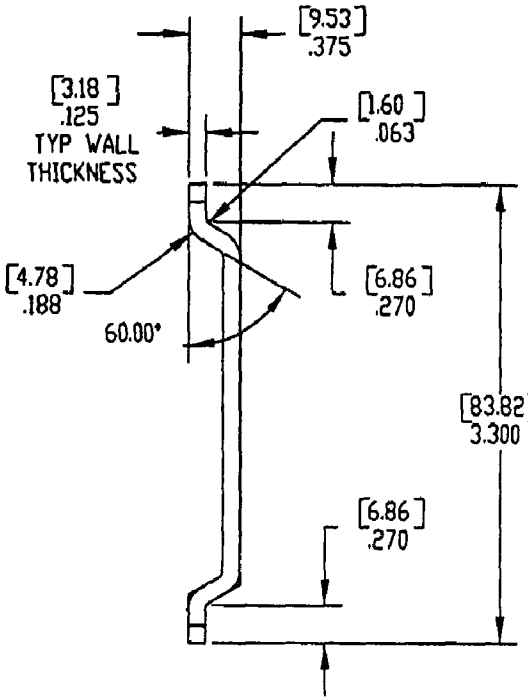

FIG. 11(*a*) shows a side view of an example of a strut positioning system 600 comprising a rack plate 610 attached to the support frame 200, gear 615, and ratchet system 620. Rack plate 610, shown in greater detail in FIGS. 12(*a*)–(*d*), advantageously comprises a zinc or cadmium plated commercial quality 1020 steel with a yield strength of 50,000 psi or greater. Gear 615 is shown in greater detail in FIGS. 14(*a*)–(*c*) and, in one aspect, made from Zinc Zamac 3. FIG. 11(*b*) shows an exploded isometric view of a ratchet system 620 including a ratchet spring plate 621 (see FIG. 13(*a*)), ratchet 622 (see FIGS. 13(*b*)–(*c*)), and ball socket 623. Ratchet spring plate 621 is made, in one aspect, from a C1095 spring steel about 0.76 mm thick. Ratchet 622 is made, in one aspect, from Zinc Zamac 3. Ball socket 623 is made from stainless steel and has a ball radius dimensioned to receive a corresponding socket of a strut 602 extension arm. In one aspect, the ball socket 623 has a threaded base having a diameter of 0.38 inches and a depth of 0.25 inches capped by a hex nut having a diameter of about 0.56 inches, upon which the ball is situated. Any of the rack plate 610, gear 615, or ratchet system 620 members could comprise other metals, alloys, materials (e.g., thermoplastic/thermosetting resins or composite materials), surface treatments or coatings in accord with the present concepts.

Figure 14A:
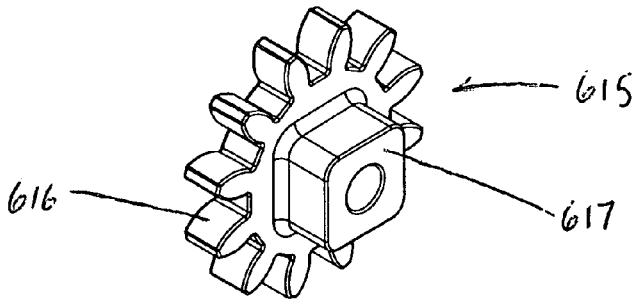
FIGS. 14(*a*)–(*c*) respectively show an isometric view, a front view, and an exploded detail view of a gear for use in the gas strut positioning system in accord with the present concepts.
Figure 14B:
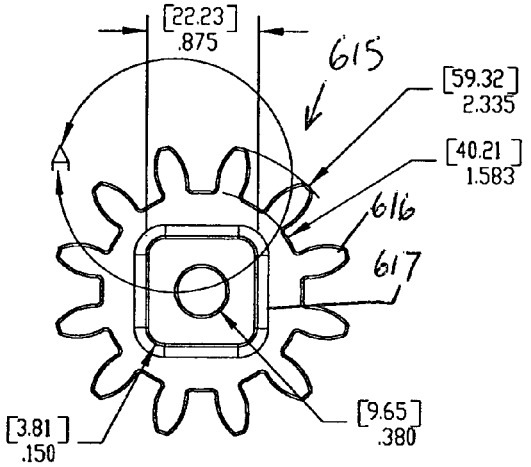
Figure 14C:
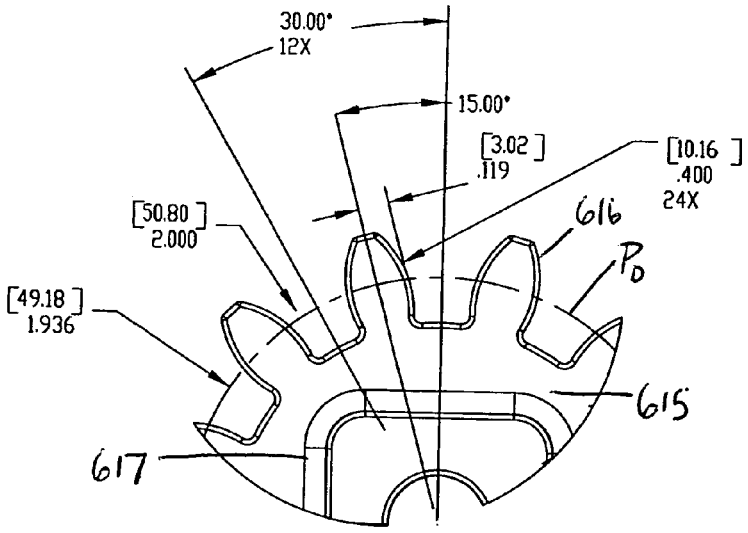

FIG. 12(*a*) shows an isometric view of a strut positioning system rack plate 610 in accord with the present concepts depicting rack teeth 611 and mounting sections 612. Rack teeth 611 are shown, in the example illustrated by FIG. 12(*d*), to have an addendum of 4.26 mm and dedendum of 5.29 mm with a pressure angle of 14.5° and a pitch of about 13.3 mm. In the example of FIG. 12(*d*), the gear 615 is expected to have a pressure angle of 14.5°, a diametral pitch of 6 with 12 teeth, a pitch diameter of 50.8 mm, an outside diameter of about 59.3 mm, a root diameter of about 40.2 mm, and a circular tooth thickness of about 0.66 mm, as shown in FIGS. 14(*a*)–(*c*). However, as known to those of ordinary skill in the art, numerous other tooth profiles and rack/pinion configurations could be utilized to the same effect and the illustrated example is not to be taken as limiting the concepts expressed herein.

Figure 13A:
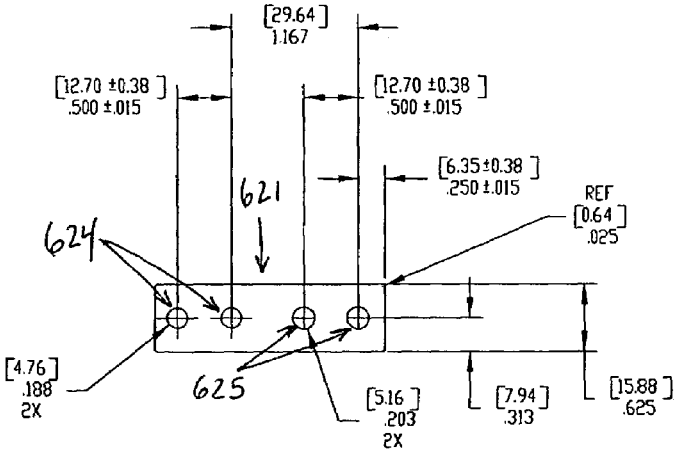
FIGS. 13(*a*)–(*c*) respectively show a top view of a ratchet spring plate, a top view of a ratchet, and a side view of a ratchet of a gas strut positioning system in accord with the present concepts.
Figure 13B:
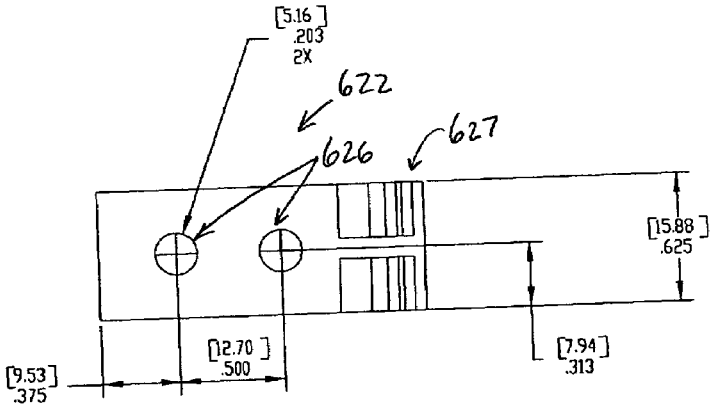
Figure 13C:
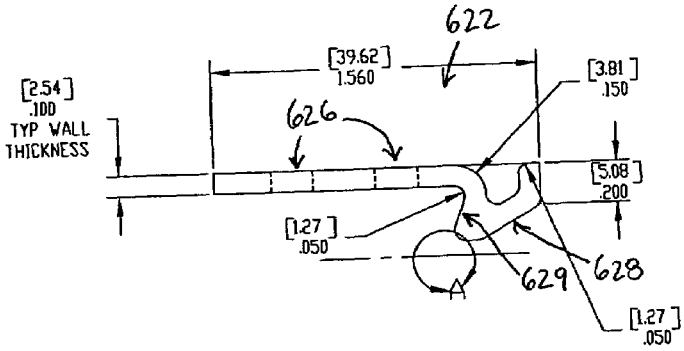

FIG. 13(*a*) shows one example of ratchet spring plate 621 wherein the ratchet spring plate is about 53.98 mm long, about 0.76 mm thick, and about 15.88 mm wide. Four through-holes 624, 625 are provided therein. In the example depicted, the left-most through-holes 624 are disposed to enable connection of the ratchet spring plate 621 to the rack plate 610 and the right-most through-holes 625 are disposed to enable connection of the ratchet spring plate 621 to the ratchet 622. The ratchet 622 is thereby cantilevered from the side of the rack plate 610 as shown, for example, in FIG. 11(*b*) and is subjected to a downward bias upon upward deflection of the ratchet 622 and spring plate 621.

FIGS. 11(*b*) and 13(*a*)–(*c*) depict one example of a ratchet 622 in accord with the present concepts. Ratchet 622 comprises through holes 626 corresponding to the right-most through-holes 625 of ratchet spring plate 621 to enable affixation thereto by conventional fasteners. Alternative means of connection between the ratchet spring plate 621 and ratchet could also be employed, such as but not limited to a welded or bonded connection, a unitary structure, or clamping device. Ratchet 622 includes, at a distal end, an engagement portion 627 configured to engage tabs 201 and openings 202 in the support frame. In one aspect, the engagement portion 627 has a first surface 628 inclined 30° from the horizontal and a second surface 629 inclined 70° from the horizontal. The second surface 629 is adapted to correspond to an aspect of the tabs 201 in which the tab is similarly inclined 70° from the horizontal, so as to permit positive engagement of the second surface to a respective tab as described in more detail below.

In another aspect, a strut positioning system 600 could comprise a track configured for mounting in a fixed position relative to and along one of a first lateral side or a second lateral side of an opening defined between one floor or space and another floor or space. Such track could be mounted, for example, on a support frame, such as described above, or on a conventional frame box, framing attached to a joist, or directly to a joist itself. In this aspect, a slide plate is provided that is configured for translational movement within the track from a first position to a second position, wherein the first position corresponds to a non-compressed state of the strut (e.g., a gas strut, a hydraulic strut, or a spring strut) and the second position corresponds to a compressed state of the strut. A locking member for locking the slide plate in the second position is also provide such that, upon connection of a distal end of the strut to a ladder or to a link member attached to a ladder and upon compression of the strut, the slide plate is locked in the second position by the locking member.

As with the first example of a strut positioning system 600, it is preferred that such track comprises a plurality of landings disposed between the first position and the second position and configured to prevent reverse translation of the slide plate in a direction toward the first position past the landing under a bias of the strut. In one aspect, the landings may comprise a tooth having at a rearwardly slanted front face and a rear face having a perpendicular attitude or a forwardly slanted face. The slide plate would correspondingly possess a ratchet tooth front face having a perpendicular or a forwardly slanted face complementing a shape of a rear face of the track landing tooth and having a forwardly slanted rear face having a shape substantially complementing a shape of the track landing tooth front face. It is preferred, in this example, that the slide plate comprises an outwardly biased ratchet tooth extending from at least one side thereof (e.g., a top and/or a bottom side). Thus, the slide plate tooth is biased into engagement with the track landing tooth to thereby permit motion of the slide plate in only one direction. A plurality of track landings may be provided substantially contiguous to one another to comprise, in combination, a linear pawl. Such linear pawl may be provided along only along a top or a bottom of the track, or may be provided along both the top and the bottom of one or more tracks. Once the slide plate is appropriately oriented in the second position, the slide plate may be fixed by a conventional mechanical fastener (e.g., screw, rivet) or may be locked in place by the action of the aforementioned ratchet tooth and linear pawl.

The strut positioning system 600 provided herein further significantly permits a single person installation.

Prior to installation, a rough opening must be made in the ceiling roughly corresponding to and larger than that of the folded ladder. If the folding ladder is wider than a spacing between ceiling joists, appropriate reinforcements and bracing should be provided prior to cutting the ceiling joists so as to prevent sagging and to maintain structural integrity. For example, two headers and a stringer could be constructed of 2" lumber and nailed securely to the ceiling joists, in a manner to those of ordinary skill in the art. In accord with the example herein, a rough opening that is 22½"×54" is formed at a position eight feet off the ground.

As previously noted, one aspect of the folding ladder support frame provides a support frame comprising four sections (head plate 210, a right side plate 220, a left side plate 230, and a foot plate 240) which may be assembled at a job-site together and fastened together, such as by screws or rivets, to form a continuous frame. In some instances, installation of a support frame or of a complete perimeteral support frame is not necessary and this step may be omitted, as appropriate. Once assembled, as necessary, the support frame 200 is lifted into the rough opening in the ceiling and positioned with framing hooks (not shown) on the head plate 210. The head-plate 210 of the frame 200 should be pushed as far forward against the frame as possible and the frame should be installed with the bottom of the frame located about 0.150" from the bottom of the drywall on the ceiling so as to provide a flush transition between the ceiling and the panel 300. The center of the head plate 210 should be centered within the framed hole, such as by sliding the head plate by tapping on the edges of the frame hooks. The support frame 200 is then fastened to the wooden joists by a mechanical fastener, such by using ¼"×1 ½" lag screws. The lag screws are driven into the wood through four lag screw holes disposed on each side plate of the support frame 200. Although the positioning of these holes is relatively arbitrary, in one aspect four holes are located on the centerline of the support frame side plate 220, one hole being located at the foot plate 230, one located in the center of the side plate 220 and two holes located near the support frame head plate 210. The lag screws should be driven in fully to secure the frame to the joists.

The folded ladder 100 assembly may then be positioned within the door hinge slots 212 located on the frame head plate 210. When this step is complete, the folded ladder 100 will be hanging straight down from the hooks (a strap still holds the ladder sections together at this point). The ladder 100 may then be fastened to the frame 200 head plate 210 using a mechanical fastener, such as ¼"×1½" lag screws by fastening the lag screws into the wood through a number (e.g., four) of lag screw holes that provided on the door hinge 215 and on the head plate 210 of the frame 200 until the door hinge and frame head plate are tight against the wooden joist. Then, using a ladder (such as a 6 foot ladder facing the folding ladder assembly 100), ascend the ladder (e.g., to the $3^{rd}$ or $4^{th}$ step) to temporarily remove the nuts and spacers from the bolts attached to the frame. The ladder assembly 100 is then pivoted forwardly until the folded ladder is at about a 65° angle from the ceiling to permit attachment of two curved brackets 216. Each curved bracket 216 will be placed over the bolt, pin or river protruding from the frame. Once the brackets are in place, a spacer and nut are fastened to each bracket the nut tightened to the bracket in such a manner as to enable the bracket to slide freely. A post bearing a ball joint is provided at a top of the ladder assembly 100. This post is adapted to be pivoted and fits into a respective attachment slot in the curved bracket 216. The post is preferably configured (e.g., rounded) so as to minimize friction between the post and the curved bracket attachment slot. Once in position, the nut to the bolt that holds the post in place is tightened.

To attach the struts, a proximal or base end (i.e., a larger diameter end) of each strut 602 is snapped into place over a respective post ball joint located on a side of the ladder assembly 100. A distal or terminal end of each strut 602 is attached to the rack plate 610 ball socket 623 that slides inside the frame side plate 230. Once the strut has been attached, a wrench (e.g., a ⅞" wrench) is used to turn the gear 615 until the strut is compressed, with the rack plate 610 snapped into its fourth and final position. For example, if looking at the head plate 210 of the support frame 200, the gear 615 on the left frame side plate 230 will be turned in a counter-clockwise direction, while the gear 615 on the right frame side plate 230 will be turned in a clockwise direction.

Rack plate 610 and ratchet system 620, such as shown in FIGS. 7(*a*) and 11(*b*) are configured to sequentially encounter, deflect, and pass over each of the tabs 201 as the strut 602 is compressed. The tabs 201 serve as backstops or locks against inadvertent and sudden extension by the strut 602, which could otherwise cause injury to the installer or damage to the folding ladder 100 or related components. Once the strut 602 has been substantially fully compressed, in a location corresponding to the fourth tab 201, the rack plate 610 may then be secured to the support frame side 230, such as by a ¼"×1½" lag screw through a hole on the rack 610 above the ratchet system and into the wood joist.

The proximal end of each strut 602 is adapted to slide, by virtue of the post, within the attachment slot in the curved bracket 216 and the distal end of each strut 602 is fixed in the configuration noted above. Thus, the struts 602 are initially installed in the fully open position with a distal end of each gas strut attached to ratchet system 620 ball socket 623 and a proximal end of each gas strut to a bracket 108 attached to a ladder rail 105, 106, whereafter the strut 602 may then be compressed to a set final position.

Without the above-described positioning system, a folding ladder employing a gas strut would require a strut distal end to be fixed to the support frame through a suitable connection and the strut proximal end to be secured to the ladder. Such folding ladder configuration would have to be installed at a position rotated backward substantially past its 90° resting position to place the system in the proper position to rotate the ladder back sufficiently to compress the strut. The need to rotate the entire ladder assembly in this manner would require a substantial amount of open space around where the folding ladder is to be installed, which would be detrimental to some space-limited applications. Moreover, unlike conventional folding ladder systems, which require the use of at least two individuals to install the strut, the above-described positioning system permits installation of a folding ladder by a single person.

Once the ladder is secured in place, a strap or other mechanical fastener holding that ladder sections closed would can be removed and the ladder assembly may safely be unfolded and locked in an unfolded position. To accurately position the ladder with respect to the floor or other base surface, the foot assembly 500 out of the bottom rail section until the foot rests on the floor. The foot assembly 500 may then be secured in position by an appropriate mechanical fastener. For example, a sheet metal screw may be inserted provided through the bottom section 130 rail 105, 106 and into the closest hole on the foot assembly 500 rail.

FIGS. 14(*a*)–(*c*) respectively show an isometric view, a front view, and an exploded detail view of a gear 615 for use in the gas strut positioning system in accord with the present concepts. As previously noted, the example presented herein provides a pressure angle of 14.5°, a diametral pitch of 6 with 12 teeth 616, a pitch diameter $P_D$ of 50.8 mm (2.00"), an outside diameter of about 59.3 mm (2.33"), a root diameter of about 40.2 mm (1.58"), a thickness of about 9.53 mm (0.375"), and a circular tooth thickness of about 0.66 mm (0.262"). A hub 617 having a width of 22.23 mm (0.875") and a depth of 12.7 mm (0.50") is provided to facilitate application of a wrench thereto (e.g., a ⅞" wrench) to manually turn the gear 615 to compress the strut 602 during installation of the gas strut positioning system 600. Hub 617 could alternately comprise a protruding hub or recessed opening having any shape used to permit external application of torque thereto and could include, for example, a hex-shaped hub or recess, a rectangular or square slot, cross-shaped intersecting slots. This gear configuration is specific to the particular example of the rack system described above and is not to be taken as limiting the broader concepts expressed herein.

The invention disclosed herein can be practiced by employing conventional materials, methodology and equipment. Accordingly, the details of such materials, equipment and methodology are not set forth herein in detail. In the previous descriptions, numerous specific details of one preferred example, such as specific materials, structures, etc., are set forth to provide a grounding in the present invention. However, it should be recognized that the present invention can be practiced without resorting to the details specifically set forth. In other instances, well known processing structures have not been described in detail, in order not to unnecessarily obscure the present invention. It is to be understood that the present invention is capable of use in various other combinations and environments and is capable of changes or modifications within the scope of the inventive concept as expressed herein.

We claim:

1. A strut positioning system for a foldable ladder configured installation in an opening defined between one floor or space and another floor or space, the opening having a distal side to which a ladder is rotatably attached, a proximal side to which an opening or closing torque is applied to open or close the foldable ladder, and a first and a second lateral side, the strut positioning system comprising:

at least one strut having a proximal end and a distal end;

a track configured for mounting in a fixed position relative to and along one of the first lateral side and the second lateral side of the opening defined between one floor or space and another floor or space;

a rack plate comprising gear teeth matingly engaging corresponding pinion gear teeth and comprising a connector connecting to said proximal end of said strut, said rack plate translating within said track from a first position to a second position, wherein the first position corresponds to a non-compressed state of said strut and said second position corresponds to a compressed state of said strut;

a locking device locking said rack plate in said second position;

a pinion gear comprising teeth matingly engaging corresponding rack plate gear teeth and comprising a torque application member matingly engaging a torque application tool, said pinion gear being rotatably mounted in a fixed position within said track;

wherein, upon connection of said distal end of said strut to one of a ladder and a link member attached to a ladder and compression of said strut by application of a torque to said pinion gear, said rack plate is locked in said second position.

2. A strut positioning system in accord with claim 1, wherein said track comprises at least one landing positioned between said first position and said second position, said landing configured to prevent reverse translation of said rack plate in a direction toward said first position past said landing under a bias of said strut, and wherein said strut comprises at least one of a gas strut, a hydraulic strut, and a spring strut.

3. A strut positioning system in accord with claim 2, wherein said landing comprises a tab and wherein said rack plate comprises a stop member adapted to permit, in combination with said tab, movement of said rack plate over said tab only in a direction from the first position toward the second position.

4. A strut positioning system in accord with claim 3, wherein said stop member comprises a ratchet resiliently mounted on said rack plate.

5. A strut positioning system in accord with claim 4, wherein said stop member ratchet is resiliently mounted on said rack plate by a spring plate.

6. A strut positioning system in accord with claim 4, wherein said landing comprises an opening disposed on a side of the tab closer to the second position than the first position, and wherein said ratchet is configured to engage both said tab and the opening.

7. A strut positioning system in accord with claim 1, further comprising:

a second track configured for mounting in a fixed position relative to and along another one of the first lateral side and the second lateral side of the opening defined between one floor or space and another floor or space;

a second rack plate comprising gear teeth configured to matingly engage corresponding pinion gear teeth and comprising a connector for connecting to said proximal end of a second strut, said second rack plate being configured for translational movement within said second track from a first position to a second position, wherein the first position corresponds to a non-compressed state of said second strut and said second position corresponds to a compressed state of said second strut;

a second locking device configured to lock said second rack plate in said second position;

a second pinion gear comprising teeth configured to matingly engage corresponding second rack plate gear teeth and comprising a torque application member configured to matingly engage a torque application tool, said second pinion gear being configured to be rotatably mounted in a fixed position on the lateral side of the opening within said second track.

8. A strut positioning system for a foldable ladder configured for installation in an opening defined between one floor or space and another floor or space, the opening having a distal side to which a ladder is rotatably attached, a proximal side to which an opening or closing torque is applied to open or close the foldable ladder, and a first and a second lateral side, the strut positioning system comprising:

at least one strut having a proximal end and a distal end;

a track configured for mounting in a fixed position relative to and along one of the first lateral side and the second lateral side of the opening defined between one floor or space and another floor or space;

a slide plate connected to the proximal end of said strut and translating within said track from a first position to a second position, wherein the first position corresponds to a non-compressed state of said strut and said second position corresponds to a compressed state of said strut;

a locking member locking said slide plate in said second position;

wherein, upon connection of said distal end of said strut to one of a ladder and a link member attached to a ladder and compression of said strut, said slide plate is locked in said second position by said locking member, and said track comprises a plurality of landings disposed between said first position and said second position, said landings preventing reverse translation of said slide plate in a direction toward said first position past said landing under a bias of said strut.

9. A strut positioning system in accord with claim 8, wherein said strut comprising at least one of a gas strut, a hydraulic strut, and a spring strut.

* * * * *